United States Patent [19]

Challeton et al.

[11] 4,322,454

[45] Mar. 30, 1982

[54] PROCESS FOR REGULATING TO DESIRED VALUES THE DIMENSIONS OF THE BUBBLES OF MAGNETIC BUBBLE ELEMENTS

[75] Inventors: Didier Challeton, St. Egrêve; Jacques Daval, Meylan; Bernard Ferrand, Voreppe; Hubert Moriceau, St. Martin d'Héres, all of France

[73] Assignee: Commissariat a l'Energie Atomique, Paris, France

[21] Appl. No.: 190,389

[22] Filed: Sep. 24, 1980

[30] Foreign Application Priority Data

Oct. 3, 1979 [FR] France ..... 79 2463

[51] Int. Cl.[3] ..... B05D 5/12

[52] U.S. Cl. ..... 427/128; 428/900

[58] Field of Search ..... 427/128–132, 427/48; 428/900

*Primary Examiner*—Bernard D. Pianalto

*Attorney, Agent, or Firm*—Michael N. Meller; Anthony H. Handal

[57] ABSTRACT

Process for regulating to desired values the size of the bubbles of magnetic bubble elements during the manufacture of such elements by liquid phase deposition into a non-magnetic substrate of a ferrimagnetic garnet film of formula:

$$(T_a{}^1T_b{}^2T_c{}^3Ca_d)\ (Fe_eGe_g)\ O_{12}$$

in which $T^1$, $T^2$ and $T^3$, which differ from one another, represent an element in the series of rare earths, including yttrium, a,b,c and d are numbers such that their sum is substantially equal to 3 and e and f are numbers such that their sum is substantially equal to 5, wherein such elements are produced by using epitaxy baths comprising calcium oxide or carbonate and predetermined quantities of ferric oxide, oxides of elements $T^1$, $T^2$ and $T^3$ and germanium oxide, wherein calcium carbonate or oxide quantity of each epitaxy bath is regulated as a function of the size of the bubbles which it is desired to obtain in the element produced from said bath and wherein the deposition of said element takes place at a temperature $t_d$ selected as a function of the saturation temperature $T_s$ of the bath to obtain a growth velocity adapted to the size of the bubbles which it is desired to obtain, the deposit being made during a time t such that the element obtained has a thickness similar to that of the bubbles obtained.

8 Claims, 1 Drawing Figure

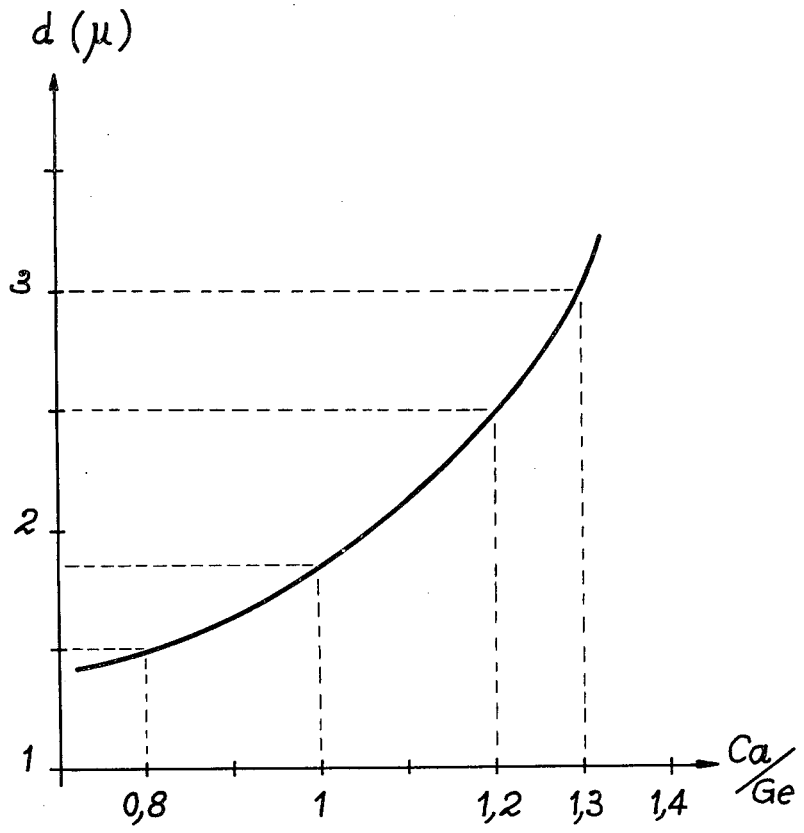
d (μ)
3
2
1
0,8
1
1,2
1,3
1,4
Ca/Ge

PROCESS FOR REGULATING TO DESIRED VALUES THE DIMENSIONS OF THE BUBBLES OF MAGNETIC BUBBLE ELEMENTS

BACKGROUND OF THE INVENTION

The present invention relates to a process for regulating to desired values the dimensions of bubbles of magnetic bubble elements during their production by liquid phase epitaxy.

It is pointed out that a magnetic bubble element is constituted by a magnetic layer with small magnetic domains having an opposite magnetic induction to that of the material surrounding them in the layer.

In a monocrystalline magnetic layer, such as a magnetic garnet film having a uniaxial magnetic anisotropy perpendicular to the plane of the layer, it is possible to create generally cylindrical magnetic domains in which the magnetic induction is of the opposite direction to that in the remainder of the layer.

These domains, which are normally "bubbles" are stabilized at their operating size under the action of a continuous magnetic field, called the polarization field. The latter must be perpendicular to the layer and the domains can be displaced in the plane of the layer under the action of propagation means magnetized by a rotary magnetic field applied in the plane of the layer. In this way, it is possible to produce circuits, comparators, memories, etc.

More specifically, the present invention relates to the preparation of magnetic bubble elements constituted by ferrimagnetic garnet films deposited by liquid phase epitaxy on a non-magnetic garnet substrate, said films preferably being magnetized perpendicular to the plane of the film. In such films, the magnetic domains appear in the form of cylinders with a circular cross-section, for example, positive on the upper face of the layer and negative on the lower face from the magnetic standpoint and in this way they form magnetic dipoles having an axis perpendicular to the displacement plane.

In connection with the construction of magnetic bubble memories, it is known that their capacity is directly linked with the diameter of the magnetic bubbles. Thus, to obtain a capacity of 256 kbits, elements are used, whose bubbles have a diameter of 2.7 μm, whilst to obtain capacities up to 0.5 and 1 megabit it is necessary to use elements whose magnetic bubbles have a diameter of 3 to 1.5 μm, preferably 2.5 and 1.8 μm.

Thus, in connection with the construction of magnetic bubble memories, considerable importance is attached to processors making it possible to adjust the diameter of the magnetic bubbles of such elements to the desired values.

Hitherto, in the processes for the production of magnetic bubble elements by liquid phase epitaxial deposit, the diameter of the element bubbles has been controlled by acting on the composition of the epitaxy bath comprising oxides or carbonates of the elements used in the composition of the film.

Thus, in the case of garnet films of formula:

$$T_a^1T_b^2T_c^3Ca_d)\ (Fe_eGe_f)O_{12}$$

in which $T^1$, $T^2$ and $T^3$, which differ from one another, represent an element in the series of rare earths including yttrium and a, b, c and d are numbers such that their sum is substantially equal to 3, whilst e and f are numbers such that their sum is substantially equal to 5, the diameter of the bubbles has been controlled by modifying the composition of the epitaxy bath with respect to the quantities of the different rare earths oxides for influencing the anisotropy and on the quantity of germanium oxide for modifying the magnetization. (Materials Research Bulletin, Vol. 10, No. 1, 1975 and Journal of Crystal Growth, Vol. 12, No. 1, December 1977).

Thus, in processes for the production of bubble memories as desired in the Journal of Crystal Growth, Vol. 12, No. 1, December 1977, certain conditions must be respected in order to obtain films with a satisfactory quality.

Thus, for reducing the diameter d of bubbles of the element, it is necessary to reduce the characteristic length l of the film on wishing to respect the condition according to which said diameter d is similar to the thickness h of the film in order to obtain a good stability of the bubbles. This can be achieved by increasing the magnetization of the film because the characteristic length l is defined by the formula:

$$l = \frac{\sqrt{AKu}}{\pi M_s}\ 2$$

in which A represents the exchange constant, Ku the uniaxial anisotropy constand and $M_s$ the saturation magnetization.

However, on increasing the saturation magnetization $M_s$ of the film, the anisotropy field $H_k$ is generally reduced making it difficult to respect the condition:

$$H_k - 4\pi M_s \geqq 700 \text{ oersteds}$$

necessary for preventing spontaneous nucleation of the bubbles. In addition, in order to respect this condition, it is necessary to influence the respective quantities of the rare earths to increase the anisotropy field $H_k$.

However, this control method involving on the one hand the respective quantities of the different rare earths and on the other the germanium quantity in the epitaxy bath has the disadvantage of requiring a relatively large change in the epitaxy bath composition to change from one bubble diameter to another.

BRIEF SUMMARY OF THE INVENTION

The problem of the invention is a process for regulating the size of bubbles of magnetic bubble elements which obviates the disadvantage referred to hereinbefore.

The invention therefore relates to a process for regulating to desired values the size of the bubbles of magnetic bubble elements during the manufacture of such elements by liquid phase deposition into a non-magnetic substrate of a ferrimagnetic garnet film of formula:

$$(T_a^1T_b^2T_c^3Ca_d)\ (Fe_eGe_g)O_{12}$$

in which $T^1$, $T^2$ and $T^3$, which differ from one another, represent an element in the series of rare earths, including yttrium, a, b, c and d are numbers such that their sum is substantially equal to 3 and e and f are numbers such that their sum is substantially equal to 5, wherein such elements are produced by using epitaxy baths comprising calcium oxide or carbonate and predetermined quantities of ferric oxide, oxides of elements $T^1$, $T^2$ and $T^3$ and germanium oxide, wherein calcium carbonate or oxide quantity of each epitaxy bath is regulated as a function of the size of the bubbles which it is desired to obtain in the element produced from said bath and wherein the deposition of said element takes place at a temperature $T_d$ selected as a function of the saturation temperature $T_s$ of the bath to obtain a growth velocity adapted to the size of the bubbles which it is desired to obtain, the deposit being made during a time t such that the element obtained has a thickness similar to that of the bubbles obtained.

Advantageo usly, the deposition temperature $T_d$ is selected so as to obtain a growth velocity at the most equal to 1.5 μm/min. For example, a growth velocity of 0.5 to 1.5 μm/min is advantageous for bubble sizes from 1.5 to 3 μm.

According to the invention, the ferromagnetic garnet film is preferably according to the following formula:

$$(Y_aSm_bLu_cCa_d)\ (Fe_eGe_f)O_{12}$$

The process as characterized hereinbefore more particularly has the advantage of making it possible to adjust to the desired value the diameter of the bubbles of the element by acting solely on the calcium quantity present in the form of calcium oxide or calcium carbonate in the epitaxy bath. Thus, the characteristic length l of the film bath can be regulated and consequently the diameter d of the bubbles, which is substantially equal to 8 or 91, when the film thickness is similar to the diameter of the bubbles. It is also possible to influence the properties of the films, particularly the anisotropy.

Thus, it has been possible to show that the anisotropy is proportional not only to the calcium quantity entering the dodecahedral sites, but also on the germanium quantity entering the tetrahedral sites. This creates a preferred order on each of the sites, which contributes to the deformation of the garnet structure and to the growth anisotropy.

It has been found that for a constant value of 1, the magnetization and anisotropy decreases when the calcium quantity in the epitaxy bath increases.

Taking account of a certain partition coefficient, it is believed that the calcium enters the dodecahedral sites and that an equivalent quantity of germanium enters the tetrahedral sites by a charge compensation mechanism. Furthermore, on increasing the calcium quantity in the epitaxy bath a larger germanium deposit is obtained in the film and consequently magnetization is reduced.

With regard to the anisotropy which, according to the prior art is essentially due to a certain arrangement of the rare earths in the dodecahedral sites, it is also believed that an order is created in the tetrahedral sites where iron and germanium coexist with very different ion radii. This order creates a supplementary component to the growth anisotropy. However, when the calcium and therefore germanium quantity increases, there is a reduction in the total anisotropy of the film, which would appear to indicate that this complementary component is subtracted from that from the dodecahedral sites.

The epitaxy baths used in the process according to the invention also contain a solvent, which is advantageously constituted by a mixture of boric oxide and lead oxide, preferably in a molar ratio of lead oxide to boric oxide of approximately 15.6.

The quantities of the different oxides present in the epitaxy bath are also determined in such a way that the bath leads to a film having satisfactory magnetic properties.

Advantageously, when it is desired to obtain elements, whose bubbles are between 1.5 and 3 μm, the epitaxy bath composition is such that the molar ratio $R_1$ of ferric oxide to oxides of rare earths is between 20 and 25, the molar ratio $R_2$ of ferric oxide to germanium oxide is between 5 and 8, the molar ratio $R_4$ of dissolved species to solvent plus dissolved species is between 0.10 and 0.15, the molar ratio $R_5$ of calcium oxide or carbonate to germanium oxide is between 0.8 and 1.8 and the molar ratio $R_6$ of calcium carbonate or oxide to oxides of rare metals is between 3 and 8. It is pointed out that the saturation temperature $T_s$ of epitaxy baths having such a composition is between 900° and 980° C.

According to the process of the invention, garnet films from such epitaxy baths are deposited on non-magnetic substrates, preferably made from $Gd_3Ga_5O_{12}$.

Advantageously, the growth of the film on the substrate is obtained by a horizontal immersion of the latter with a unidirectional rotation of approximately 200 r.p.m. under isothermal conditions. At the saturation temperature of the bath, the deposition temperature $T_d$ is below 10° to 30° C. and is selected as a function of the bath saturation temperature $T_s$ so as to obtain a growth velocity suitable for the size of the bubbles which it is desired to obtain. For example, a growth velocity at the most equal to 1.5 microns/minute and preferably between 0.5 and 1.5 micron/minute is used when the calcium quantity of the bath is adjusted to obtain bubbles between 1.5 and 3 μm.

Thus, a film composition having desired magnetic properties corresponds to each value of $T_d$. A growth velocity $V_a$ which fixes the deposition time t such that $Vat=h\simeq d\simeq 81$ to 91 also corresponds to each value of $T_d$.

Clearly, by selecting the temperature $T_d$, it is possible to regulate in per se known manner the growth velocity, the deposition time and the thickness of the deposited layer in order that said thickness is approximately equal to the desired bubble diameter, with a general tolerance of ±0.5 μm.

Thus, the growth velocity is a very important factor in obtaining bubble magnetic layers. Thus, it evolves over a period of time, decreasing between the start and finish of the growth of one layer and decreasing as a function of the number of layers deposited beforehand from the same bath. When the growth velocity is too high at the start of deposition, the layer is so irregular that stable bubbles cannot be produced in it. This phenomenon fixes the growth velocity to be adopted and is dependent on the size of the bubbles which it is desired to obtain from the bath.

Moreover, to obtain a magnetic bubble element satisfying the stability conditions, it is necessary for the element thickness to be close to the diameter of the bubbles obtained, as pointed out in the article by Parker and W. R. Cox (Journal of Crystal Growth 42, 1977, pp. 334 to 342). In addition, the film deposition time t is regulated so as to obtain the desired thickness.

BRIEF DESCRIPTION OF THE FIGURE AND PREFERRED EMBODIMENTS

The invention is described in greater detail hereinafter in an illustrative and non-limitative manner, with reference to the attached drawing which shows the evolution of the diameter of the bubbles of the element obtained, as a function of the molar ratio between the calcium carbonate and the germanium oxide of the epitaxy bath.

A number of epitaxy baths are prepared and they only differ by their calcium carbonate content. Each bath contains quantities of ferric oxide $Fe_2O_3$, yttrium oxide $Y_2O_3$, samarium oxide $Sm_2O_3$, lutetium oxide $Lu_2O_3$, germanium oxide $GeO_2$ and solvent constituted by lead oxide PbO and borix oxide $B_2O_3$, such that the molar ratio $R_1$ of ferric oxide to oxides of rare earths is 22.20, the molar ratio $R_2$ of ferric oxide to germanium oxide is 5.18 and the molar ratio of lead oxide to boric oxide is 15.6. In the various epitaxy baths, the calcium carbonate quantity is such that the molar ratio $R_5$ of calcium carbonate to germanium oxide varies between 0.8 and 1.3. The different epitaxy baths thus have the characteristics given in the attached table in connection with the value for ratios $R_4$, $R_5$ and $R_6$ and the saturation temperature $T_s$.

Using these epitaxy baths, garnet films are deposited on substrates of $Gd_3Ga_5O_{12}$ with a diameter of approximately 2.54 cm and a thickness of 0.5 mm. For each deposit, the substrate is rotated at a speed of 200 r.p.m. and the deposition temperature is regulated as a function of the bath saturation temperature, so that the bath has a supersaturation $\Delta T = Ts - Td$ between 10° and 30° C.

The physical properties of the film are checked after it has been deposited. The film thickness h is measured by the inteference method. The characteristic length l and the saturation magnetization $4\pi$ Ms are determined on the basis of the diameter d of the bubbles and the bubble collapse filed $H_O$ measured by the Fowlis and Copeland method and the film thickness h. The uniaxial anisotropy field $H_k$ is determined by ferromagnetic resins. The coercive field $H_c$ is also determined by exciting a configuration with strip domains by an alternating magnetic field directed in accordance with the crystal direction (1,1,1) and by determining the magnetization photoelectrically by means of the Faraday effect.

The results obtained are given in the attached table.

It is apparent from the table that for each value of the molar ratio $C_a/G_a$ a particular bubble diameter is obtained, whilst the films obtained have satisfactory characteristics from the growth standpoint and from the standpoint of physical properties (magnetization and anisotropy).

The attached drawing illustrates the development of the diameter of the bubbles obtained as a function of the molar ratio Ca/Ge (calcium carbonate/germanium oxide) in the epitaxy bath. It is apparent that the Ca/Ge ratio to be used can be determined as a function of the bubble diameter which it is desired to obtain.

The above description gives the results obtained with calcium carbonate as the calcium compound. Results can also be obtained with calcium carbonate, the carbonate changing into oxide in the epitaxy bath.

Moreover, the tests have shown that the process according to the invention can also be used by replacing samarium by europium and lutetium by ytterbium or thulium.

TABLE

| Bath | $R_4$ | $R_5$ | $R_6$ | $T_d$(°C.) | ΔT(°C.) | $V_d$(μm/min) | Time t(min) | d(μm) | l(μm) | $H_k$ (oersted) | $4\pi$Ms (G) | $H_c$ (oersted) |
|---|---|---|---|---|---|---|---|---|---|---|---|---|
| No. 1 | 0.130 | 0.8 | 3.43 | 900 | 25 | 0.55 | 3 | 1.5 | 0.17 | 1250 | 550 | 0.2 |
| No. 2 | 0.133 | 1.0 | 4.29 | 910 | 25 | 0.70 | 2.30 | 1.8 | 0.20 | 1200 | 450 | 0.3 |
| No. 3 | 0.136 | 1.2 | 5.14 | 930 | 30 | 0.85 | 2.30 | 2.5 | 0.28 | 1350 | 350 | 0.4 |
| No. 4 | 0.139 | 1.3 | 6.00 | 950 | 30 | 1 | 3 | 3 | 0.34 | 1650 | 300 | 0.5 |

What is claimed is:

1. A process for regulating to desired values the size of the bubbles of magnetic bubble elements during the manufacture of such elements by liquid phase deposition into a non-magnetic substrate of a ferrimagnetic garnet film of formula:

$$(T_a^1T_b^2T_c^3ca_d)(Fe_eGe_g)O_{12}$$

in which $T^1$, $T^2$ and $T^3$, which differ from one another, represent an element in the series of rare earths, including yttrium, a, b, c and d are numbers such that their sum is substantially equal to 3 and e and f are numbers such that their sum is substantially equal to 5, wherein such elements are produced by using epitaxy baths comprising calcium oxide or carbonate and predetermined quantities of ferric oxide, oxides of elements $T^1$, $T^2$ and $T^3$ and germanium oxide, wherein calcium carbonate or oxide quantity of each epitaxy bath is regulated as a function of the size of the bubbles which it is desired to obtain in the element produced from said bath and wherein the deposition of said element takes place at a temperature $T_d$ selected as a function of the saturation temperature $T_s$ of the bath to obtain a growth velocity adapted to the size of the bubbles which it is desired to obtain, the deposit being made during a time t such that the element obtained has a thickness similar to that of the bubbles obtained.

2. A process according to claim 1, wherein the temperature $T_d$ is chosen in such a way that a growth velocity at the most equal to 1.5 μm/min is obtained

3. A process according to claims 1 to 2, wherein $T^1$, $T^2$ and $T^3$ respectively represent yttrium, samarium or europium and lutetium, ytterbium or thulium.

4. A process according to claim 1, wherein the epitaxy baths contain a solvent constituted by a mixture of boric oxide and lead oxide.

5. A process according to claim 4, wherein the molar ratio of lead oxide to boric oxide is approximately 15.6.

6. A process according to claims 4 or 5, wherein the size of the bubbles of the elements obtained is regulated to a value between 1.5 and 3μ by using epitaxy baths having a composition such that the molar ratio $R_1$ of ferric oxide to oxides of rare earths is between 20 and 25, the molar ratio $R_2$ of ferric oxide to germanium oxide is between 5 and 8, the molar ratio $R_4$ of dissolved species to solvent plus dissolved species is between 0.10 and 0.5, the molar ratio $R_5$ of calcium compound to germanium compound is between 0.8 and 1.8 and the molar ratio $R_6$ of calcium compound to oxides of rare earths is between 3 and 8.

7. A process according to claim 6, wherein to obtain elements with magnetic bubbles, whose bubble sizes vary from 1.5 to 3μ epitaxy baths are used which contain quantities of ferric oxide, oxides of rare earths and germanium oxides such that the molar ratio $R_1$ is 22.2 and the molar ratio $R_2$ 5.18 and wherein the content of the calcium compound in said baths is varied in such a way that the molar ratio $R_5$ varies from 0.8 to 1.3.

8. A process according to claims 6 or 7, wherein the deposition of the element takes place at a temperature $T_d$ selected in such a way that a growth velocity of 0.5 to 1.5 μm/min is obtained.

* * * * *